United States Patent [19]

Robertson

[11] 4,163,903

[45] Aug. 7, 1979

[54] FLAME MONITORING APPARATUS

[75] Inventor: Donald Robertson, Ambler, Pa.

[73] Assignee: Leeds & Northrup Company, North Wales, Pa.

[21] Appl. No.: 845,985

[22] Filed: Oct. 27, 1977

[51] Int. Cl.[2] ..... G08B 21/00

[52] U.S. Cl. ..... 250/554; 250/227

[58] Field of Search ..... 250/554, 227; 340/578; 356/87

[56] References Cited

U.S. PATENT DOCUMENTS

| | | | |
|---|---|---|---|
| 2,840,145 | 6/1958 | Ator | 250/554 X |
| 2,840,146 | 6/1958 | Ray | 250/554 X |
| 3,689,773 | 9/1972 | Wheeler | 250/217 F |
| 3,936,648 | 2/1976 | Cormault et al. | 250/554 |
| 3,940,753 | 2/1976 | Muller | 340/227 R |
| 3,988,104 | 10/1976 | Barber | 431/90 |
| 3,995,221 | 11/1976 | MacDonald | 328/6 |
| 4,039,844 | 8/1977 | MacDonald | 250/554 |

*Primary Examiner*—David C. Nelms
*Assistant Examiner*—Darwin R. Hostetter
*Attorney, Agent, or Firm*—Raymond F. MacKay; William G. Miller, Jr.

[57] ABSTRACT

The apparatus includes a radiation gathering device having a narrow acceptance angle and mounted in a multiburner boiler to sight substantially across the discharge end of the burner nozzle. Radiation collected by the gathering device is transmitted by a fiber optic path to a radiation detecting device. The manner in which the apparatus is constructed and mounted insures that the radiation detecting device will be responsive only to the radiation resulting from the associated burner and not influenced by radiation from other burners in the boiler installation, or radiation from the boiler itself.

5 Claims, 3 Drawing Figures

FLAME MONITORING APPARATUS

SUMMARY OF THE INVENTION

This invention relates to flame monitoring apparatus for detecting the presence or absence of the flame from a burner and more particularly with respect to multiburner boiler installations.

The loss of flame in a multiburner boiler installation can create a hazardous condition should the burner continue to supply fuel to the boiler as this fuel may be explosively ignited by the flame from other burners. It is thus extremely important that a reliable system for flame monitoring be utilized that will be useful throughout the entire load range of the boiler and other conditions that may occur that significantly change the radiation within the boiler but which does not represent a burner extinguished situation. In the past, systems sensitive to the level of radiation from the flame of a burner have been unreliable as an indication of the presence of a flame from a single burner of a multiburner installation because the systems were sensitive not only to the radiation from the flame being monitored but also sensitive to the radiation from the flames of all other burners that were in operation and also to radiation from hot surfaces within the boiler. Because of this problem associated with radiation level sensors, the prior art has turned to more complex systems generally relying on the rapid, continuing variations in intensity of the burner flame by observing the corresponding variations in the level of radiation intensity rather than the average level of intensity. Such systems are inevitably more complex than a system responding purely to the average level of radiation and also tend to be responsive to variations in intensity created by other of the multiburner flames.

It is an object of this invention to provide a radiation level monitor that will accurately determine the presence or absence of flame from a single burner of a multiburner boiler without being influenced by the radiation from the other flames. To this end, a radiation gathering device having a low radiation acceptance angle is mounted in the recess of a single burner in such a way that the device gathers radiation from the flame of the burner when it is lit and in the absence of a flame from the burner does not gather radiation from the flames of any of the other burners nor from a boiler surface heated by the other flames. The radiation so gathered is then coupled by means of a light pipe or fiber optic means to a point outside of the boiler where the radiation level is sensed by a radiation detector to provide a signal representative of the presence or the absence of a flame.

Figure 1:
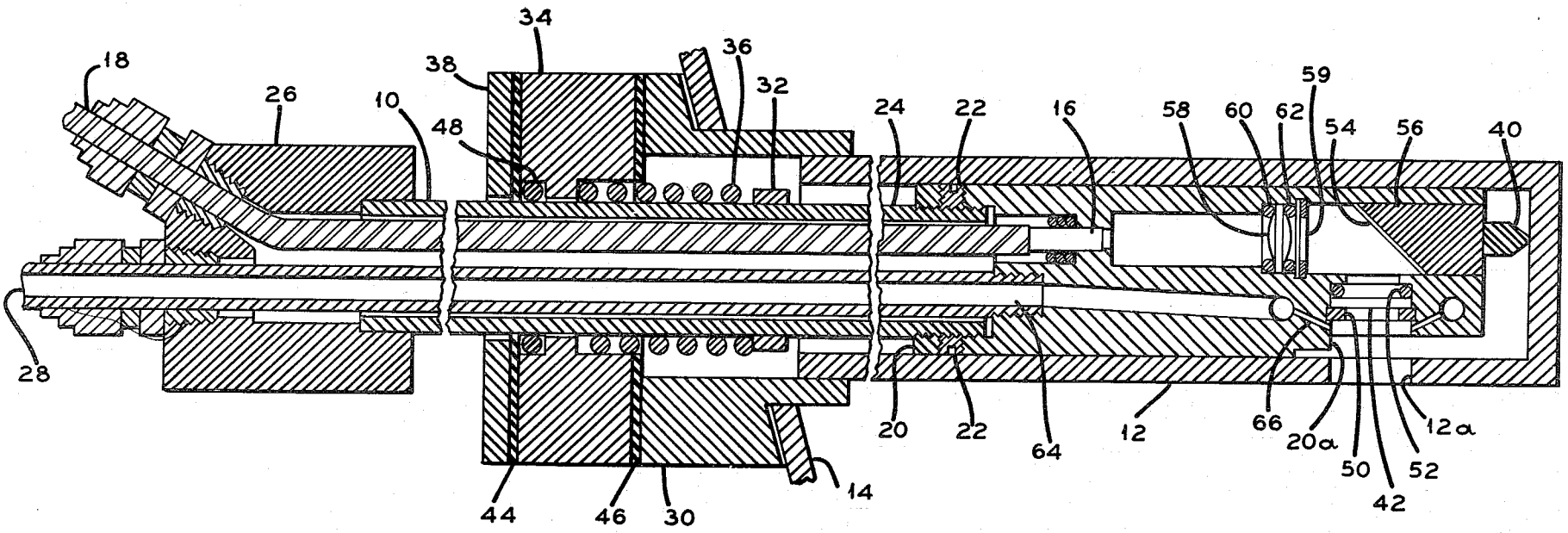
Figure 2:
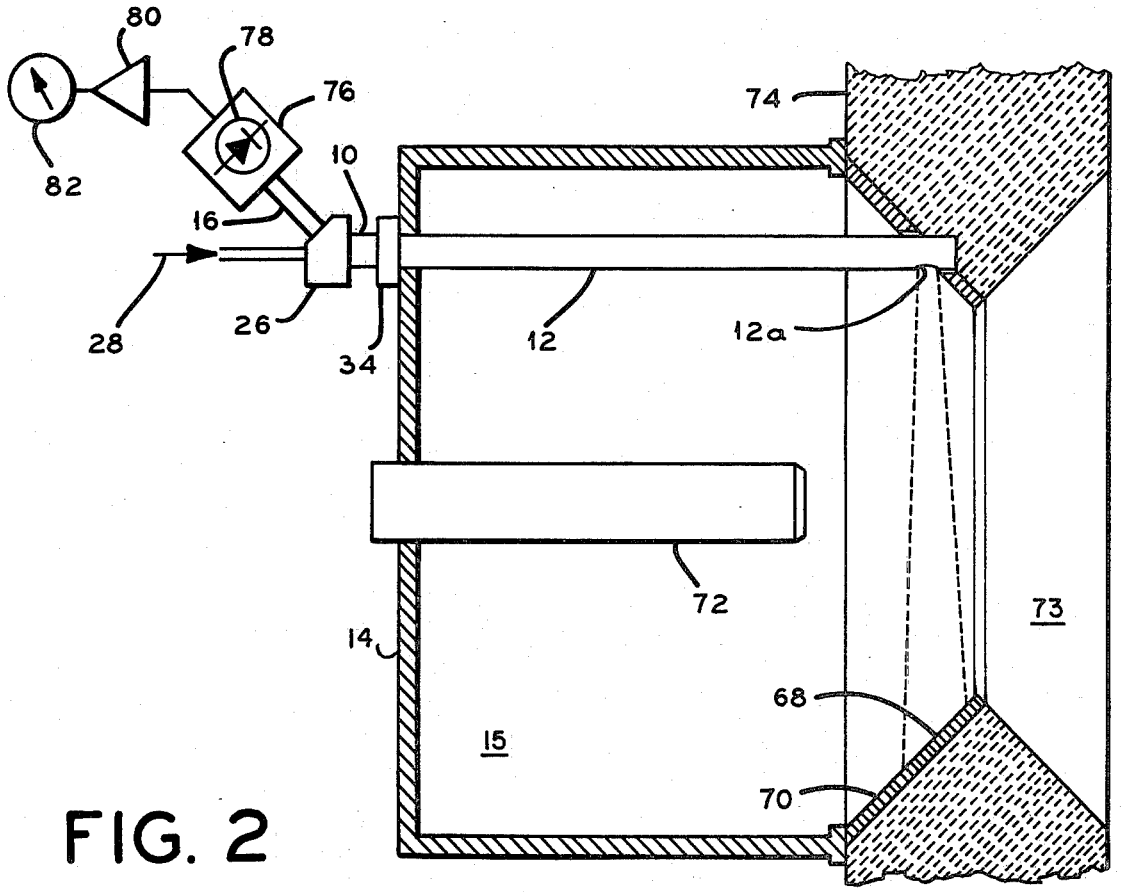
Figure 3:
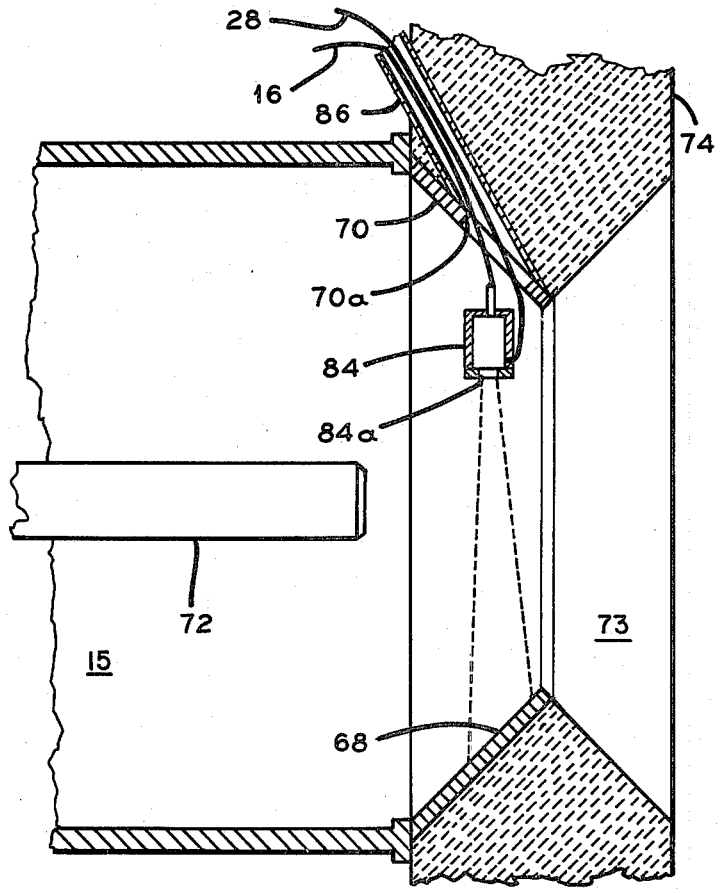

The invention will be described by way of example with reference to the accompanying drawings, wherein:

FIG. 1 discloses a probe and its mounting for insertion in a burner throat to monitor the flame condition in accordance with this invention;

FIG. 2 is a view showing the manner in which the probe mount is located with respect to the burner and the boiler; and FIG. 3 shows an alternative radiation gathering device coming within the teachings of this invention.

Referring to FIG. 1 there is shown a probe 10 mounted within a housing 12. The probe 10 is designed to collect radiation entering an opening or window **12*a* in the distal end of the housing 12 and to transmit the collected radiation by means of a light pipe which comprises a glass fiber optic element 16 enclosed within a spirally wound metal protective shield 18. The probe 10 comprises a probe end 20 secured by set screws 22 to a main pipe 24. The main pipe 24 has secured by suitable means to its proximal end a junction block 26 for providing an exit passage for the light pipe 16 and an air inlet 28. The housing 12 for the probe 10 is secured to a flange member 30 which is inserted through a hole in the boiler front plate 14 to locate the housing 12 within a windbox 15** as shown in FIG. 2.

In order to maintain the probe 10 positioned within the housing 12, a collar 32, FIG. 1, is secured to the main pipe 24 of the probe 10. A spring block 34 is slideably positioned on the main pipe 24, of the probe 10 to engage a compression spring 36. By means of a flange 38 and bolts, not shown, the spring block 34 is drawn toward the boiler front plate 14 which in turn compresses spring 36 to produce an axially directed force on collar 32 to move the probe 10 into the housing member 12. The probe 10 and the housing 12 may be appropriately keyed in conventional manner to insure that they are in angular relation for the opening **12*a* in housing 12 to align with a window 42 in the probe 10. The probe end 20 is provided with a pin stop 40 to precisely align in the axial direction the window 42 in the probe end 20 with the hole 12*a* in the distal end of housing 12. In order to seal the probe 10 to prevent leakage of air, gaskets 44 and 46 are located at each end of the spring block 34 and O-ring 48 seals the spring block 34 to the main pipe 24**.

In order to collect the radiation necessary to determine whether or not the associated burner is lit, the probe end 20 includes an opening **20*a* in which a window 42 is secured by a retaining spring member 50 and sealed by an O-ring 52. Thermal radiation passing through window 42 is reflected by a mirror 54 carried by a mirror support 56 which is sealingly secured in the end of probe end 20. A lens 58 is secured in the probe end 20 by a retaining spring ring 59 and sealed by means of O-rings 60 and 62. The lens 58 serves to define the acceptance angle of the radiation collection optical system and limits the angle so that the device is sensitive to radiation emanating from the optical path between the window 42 and a very small target area 68 (FIG. 2). It has been found that an acceptance angle of 6° for the optical system of probe 10 produced changes in infrared radiation levels sufficient to distinguish whether or not the burner flame was present. The accepted radiation as defined by the lens 58 is transmitted to the exposed end of light pipe 16 located at the end of chamber 63** for transmittal to detecting equipment located outside the boiler.

In order to maintain the window 42 free from smoke and soot, the probe 10 is equipped with an air purge whereby air entering the probe at inlet 28 flows through a passage 64 which communicates with a plurality of air jets 66 distributed about the opening **20*a*. During operation it is possible to supply air to the inlet 28 and thereby provide a flow of air out of the jets 66 to prevent the buildup of soot or smoke at the entrance to the window 42** to avoid attenuation of the signals produced by the thermal radiation within the boiler.

As shown in FIG. 2 the burner 72 is shown recessed with respect to an opening 73 in the boiler wall 72. The recess in which the burner 72 is located is formed by the opening 73 in the boiler wall 74, the throat ring 70 and the boiler front plate 14. Referring to FIG. 2 it will be seen that there has been indicated by dotted lines the acceptance angle for radiation as defined by the lens 58 and the remaining portions of the optical-system contained within the probe. This angle of acceptance defines the target area 68 on the inner surface of a burner throat ring 70 associated with a burner 72 whose flame condition is to be monitored. In accordance with the normal practice, the throat ring 70 is located in the boiler wall 74.

In accordance with the invention, the radiation collected by the probe 10 is transmitted by way of light pipe 16 to a radiation sensing means 76 which preferably includes a silicon photo diode 78 to convert the radiation received to an electrical signal in manner well known to those skilled in the art. The electrical signal from the silicon photo diode 78 is in turn connected to a conventional amplifying means 80 having its output connected to an indicating means 82. The indicating means 82 may be in the form of a meter or alternatively, may be in the form of a device having level setting means associated with it so that an indication is produced when the signal from the silicon photo diode 78 as amplified by amplifying means 80 decreases below a preset acceptable level to indicate the absence of a flame at burner 72. Usually such an arrangement would include not only a signal light indicating means but also an audible warning means, and/or a shutdown system to turn off the fuel.

With the arrangement thus far described, there is provided a system which when a flame is present at burner 72, the thermal radiation produced by the flame within the acceptance angle of the probe 10 and collected by the probe 10 is sufficiently large that the indicating element 82 provides an indication that the burner is lit. If the flame from burner 72 should become extinguished for any reason whatsoever, the optical system of probe 10 receives radiation solely from the optical path between the window and the limited target area 68 located on the inside of burner throat ring 70. In practice it has been found that radiation from this portion of the burner installation is sufficiently small, even though the other burners of a multiburner installation are lit, that a reliable and dependable level of radiation may be established below which a clear indication of extinguished burner condition can be detected. This arrangement has undergone broad testing under many varied conditions with various combination of burners of a multiburner installation firing and with various conditions of boiler load and has been found to give a highly satisfactory and dependable indication of the state of operation of the individual burner.

Referring to FIG. 3 there is illustrated a different embodiment of the present invention. In the embodiment shown in FIG. 3, the probe of FIGS. 1 and 2 has been replaced by an entrance diaphragm cylinder 84 which is positioned within the boiler throat ring 70 through a pipe 86 positioned in the refractory of the boiler wall 74 and through a hole **70*a* in the throat ring 70. In the entrance diaphragm cylinder 84, the angle of acceptance is established by a slot or diaphragm 84*a* located in the end face of the entrance diaphragm cylinder 84 opposite to the end at which the light pipe 16 terminates. Following the teachings in FIGS. 1 and 2, air is used to purge the entrance diaphragm cylinder 84 and is introduced into the cylinder by means of the air supply 28**.

While two modifications of the invention have been disclosed, one in which the optics include a lens system for defining the angle of acceptance and the other in which a slot is used to define the angle of acceptance, it is to be understood that many other types of optical systems may be employed without departing from the scope of the invention.

What is claimed is:

1. Flame monitoring apparatus capable of signalling the loss of flame from a single burner of a multiple burner installation in which each burner is individually mounted in a recess in a boiler wall comprising:

radiation collecting means mounted for collecting radiation from a limited optical path extending across the opening of said recess and terminating on a wall of said recess to collect radiation from the flame of an individual burner in said path when said flame is present and for collecting radiation from only a portion of the wall of said recess associated with said burner when said flame is out, and means connected to said radiation collecting means for producing an output signal indicative of the presence or absence of flame at said burner in response to the level of radiation collected by said radiation collecting means.

2. Apparatus according to claim 1 in which said radiation collecting means includes a light pipe for conducting radiation from said flame to said radiation sensing means.

3. Apparatus according to claim 1 in which said radiation collecting means includes means for limiting the acceptance angle for said radiation collecting means.

4. Apparatus according to claim 2 in which said light pipe includes a fiber optic element.

5. Apparatus according to claim 3 in which said means for limiting the acceptance angle includes a diaphragm.

* * * * *